US005446222A

United States Patent [19]

Boulton et al.

[11] Patent Number: 5,446,222

[45] Date of Patent: Aug. 29, 1995

[54] OLIGOMERS OF CYCLOPENTADIENE AND PROCESS FOR MAKING THEM

[75] Inventors: James R. Boulton, Chalfont, Pa.; Ross A. Kremer, Ringoes, N.J.

[73] Assignee: Mobil Oil Corporation, Fairfax, Va.

[21] Appl. No.: 262,118

[22] Filed: Jun. 17, 1994

[51] Int. Cl.[6] ..... C07C 5/22; C07C 13/00; C07C 5/23; C10L 1/16

[52] U.S. Cl. ..... 585/12; 585/17; 585/20; 585/21; 585/22; 585/23; 585/253; 585/350; 585/360; 585/361; 585/377; 585/506; 585/507; 585/530; 585/531; 585/532; 585/533

[58] Field of Search ..... 585/253, 350, 360, 361, 585/377, 506, 507, 530, 531, 532, 533, 12, 17, 20, 21, 22, 23

[56] References Cited

U.S. PATENT DOCUMENTS 4,059,644 11/1977 Cannell ..... 585/253
4,401,837 8/1983 Burdette et al. ..... 585/253

*Primary Examiner*—Asok Pal
*Assistant Examiner*—E. D. Irzinski
*Attorney, Agent, or Firm*—Alexander J. McKillop; Dennis P. Santini; Robert B. Furr, Jr.

[57] ABSTRACT

The invention provides a two-step process for converting cyclopentadiene dimer to a high density fuel mixture comprising the steps of:

(a) reacting said cyclopentadiene dimer in the presence of a solid catalyst comprising a porous crystalline material having a Constraint Index of from about 0.1 to about 12 under oligomerization/isomerization conditions to convert at least a portion of said cyclopentadiene dimer to a normally liquid intermediate product containing cyclopentadiene trimer, cyclopentadiene tetramer, and the isomerized and oligomerized products derived from the reaction of at least three cyclopentadiene monomer units;

(b) hydrogenating said normally liquid intermediate product of step (a) in the presence of a hydrogenation catalyst to form a normally liquid high energy density fuel.

22 Claims, 1 Drawing Sheet

OLIGOMERS OF CYCLOPENTADIENE AND PROCESS FOR MAKING THEM

FIELD OF THE INVENTION

This invention relates a process for making cyclopentadiene oligomers which are useful as high density fuels. The invention further provides a high density fuel comprising these cyclopentadiene oligomers.

BACKGROUND OF THE INVENTION

U.S. Pat. No. 4,059,644 to Cannell discloses a method for producing high-energy fuels by thermal (non-catalytic) reaction of a mixture of cyclopentadiene dimer and methyl cyclopentadiene dimer at 150°–220° C., and subsequent hydrogenation of the olefinic unsaturation in the oligomeric product mixture.

U.S. Pa. No. 4,401,837 to Burdette et al. discloses a method for synthesizing cyclopentadiene trimers and higher molecular weight oligomers from cyclopentadiene dimer via thermal (non-catalytic) Dieis-Alder reactions. The trimer fraction of the intermediate oligomeric product is then treated in the presence of a hydrogenation catalyst to saturate the olefinic bonds. While the initial thermal reaction produces trimers, tetramers, and pentamers, only the trimer fraction is used for the high density fuel product. After the initial reaction, the mixture is hydrogenated to saturate the olefinic bonds and distilled to recover the $C_{15}$ trimer. Thus the formation of higher molecular weight oligomers ($C_{20+}$) represents yield loss. The trimer, after hydrogenation, is a solid at room temperature with a melting point of +49° C. This trimer is then dissolved in methylene chloride and isomerized at 0°–20° C. using aluminum chloride as catalyst. The isomerized product is subsequently recovered by distillation.

These prior art processes produce a normally solid intermediate product (after hydrogenation) which must then be isomerized to form a normally liquid product. Further, the prior art processes sacrifice yield because only a portion of the oligomerized intermediate product (the trimer) is used for upgrading to the final high density fuel product. Thus it would be desirable to provide a process which avoids the costly isomerization step. Further, it would be desirable to provide a process which enhances yield by incorporating substantially all of the oligomerized intermediate product into the final high density fuel product.

SUMMARY OF THE INVENTION

This invention comprises a two-step process for converting cyclopentadiene dimer to a high density fuel mixture comprising the steps of:

(a) reacting said cyclopentadiene dimer in the presence of a solid catalyst comprising a porous crystalline material having a Constraint Index of from about 0.1 to about 12 under oligomerization/isomerization conditions to convert at least a portion of said cyclopentadiene dimer to a normally liquid intermediate product containing cyclopentadiene trimer, cyclopentadiene tetramer, and the isomerized and oligomerized products derived from the reaction of at least three cyclopentadiene monomer units;

(b) catalytically hydrogenating at least a portion of said normally liquid intermediate product of step (a) to form a normally liquid high energy density fuel.

The per-pass conversion in oligomerization/isomerization step (a) is preferably controlled to less than 100%. Extremely high single pass conversions in step (a) tend to increase the yield of $C_{20+}$ constituents, thus compromising the low temperature properties (such as pour point, cloud point, and freeze point) of the resulting fuel. Accordingly, per-pass conversions of from about 20 to about 80 weight percent are preferred, and per-pass conversions of from about 40 to about 60 weight percent are more preferred.

In one preferred embodiment, the unoligomerized dicyclopentadiene is separated from the total reaction product by distillation prior to hydrogenation, and recycled to step (a) for reuse. The recycled stream is typically enriched in non-oligomerized $C_{10}$ material. The low temperature properties of the final product may be adjusted by controlling the flow of the recycle stream to step (a). Removing and recycling a portion of the $C_{10}$ material from the effluent of step (a) improves the energy density of the resulting final product, but this improvement must be balanced against the necessary low-temperature properties, which are enhanced by relatively smaller recycle ratios. The amount of non-oligomerized $C_{10}$ material separated for recycle typically falls within the range of from about 0 to about 100%, typically from about 20 to about 100%, and preferably the necessary amount to achieve the desired low temperature properties. This recycle ratio may be determined for a particular product specification with a minimal amount of trial and error. In a particularly preferred embodiment, 100% of the unreacted dicyclopentadiene is recycled. The recycled $C_{10}$ fraction is typically separated from the step (a) effluent stream by conventional distillation methods.

In another preferred embodiment, the total effluent from the oligomerization step, containing dicyclopentadiene which has been isomerized but not oligomerized in addition to the $C_{15+}$ oligomeric product, is charged directly to the hydrogenation step with no intermediate distillation step. In the subsequent hydrogenation step, this isomerized dicyclopentadiene is converted to JP-10, a current military fuel and preferred diluent used to impart improved low-temperature properties to the fuel in applications where this is desired.

Oligomerization/Isomerization Catalysts

The crystalline materials useful as oligomerization/isomerization catalyst components in the present process have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA off-retite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The process by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

In a preferred embodiment, the catalyst is a zeolite having a Constraint Index of between about 0.1 and about 12. Examples of such zeolite catalysts include ZSM-5, ZSM-11, ZSM12, ZSM-22, ZSM-23, ZSM-35, ZSM-48, as well as MCM-22, PSH-3, SSZ-25, and zeolite Beta.

Zeolite ZSM-5 and the conventional preparation thereof are described in U.S. Pat. No. 3,702,886, the disclosure of which is incorporated herein by reference. Other preparations for ZSM-5 are described in U.S. Pat. Nos. Re. 29,948 (highly siliceous ZSM-5); 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No. 4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference. Zeolite Beta is taught by U.S. Pat. Nos. 4,696,732, 3,308,069, 5,275,719, 5,258,114, and Re. 28,341, the disclosures of which are incorporated herein by reference.

Gallium-containing catalysts may be used in the present invention and are disclosed in U.S. Pat. No. 4,350,835 and U.S. Pat. No. 4,686,312, both of which are incorporated by reference as if set forth at length herein.

Zinc-containing catalysts may be used in the present invention, for example, U.S. Pat. No. 4,392,989 and U.S. Pat. No. 4,472,535, both of which are incorporated by reference as if set forth at length herein.

Catalysts such as ZSM-5 combined with a Group VIII metal described in U.S. Pat. No. 3,856,872, incorporated by reference as if set forth at length herein, are also useful in the present invention.

Synthetic porous crystalline materials useful in the present invention also include the PSH-3 composition of U.S. Pat. No. 4,439,409, the SSZ-25 composition of U.S. Pat. Nos. 4,665,110 and 4,826,667, and the MCM-22 composition of U.S. Pat. No. 4,954,325. MCM-22 is also described in U.S. Pat. Nos. 4,992,615, 5,012,033, and 5,073,665.

The synthetic porous crystalline material, or zeolite, catalyst preferred for use in the process of this invention, referred to herein as "zeolite MCM-22" or simply "MCM-22", appears to be related to the composition named "PSH-3" described in U.S. Pat. No. 4,439,409. Zeolite MCM-22 does not appear to contain all the components apparently present in the PSH-3 compositions and is not contaminated with other crystal structures such as ZSM-12 or ZSM-5. Moreover, zeolite MCM-22 exhibits unusual sorption capacities and unique catalytic utility when compared to the PSH-3 compositions synthesized in accordance with U.S. Pat. No. 4,439,409.

Hydrogenation Catalysts

Hydrogenation catalysts useful in the second step of the present process include oxides and sulfides of Groups IVA, VA, VIA, VIIA and VIIIA and mixtures thereof on an inert support such as alumina, silica-alumina, active carbon or kieselguhr. Thus, hydrogenation may be promoted by sulfides and oxides of titanium, zirconium, vanadium, niobium, tantalum, chromium, molybdenum, tungsten and mixtures thereof. Oxides of chromium alone or in conjunction with other catalytically active species have been shown to be particularly useful in hydrogenation. Other catalytically active compounds include sulfides and oxides of manganese, iron, cobalt, rhodium, iridium, nickel, palladium, platinum and mixtures thereof.

The above-listed metals of Groups IVA, VA, VIA, VIIA and VIIIA may also be exchanged onto zeolites including those zeolites disclosed above to provide a zeolite catalyst having hydrogenation activity. Platinum has been found to be particularly useful for promoting hydrogenation over zeolite catalysts.

Process conditions useful in the oligomerization/isomerization step of the present invention are shown below.

| Catalytic Oligomerization Conversion Conditions | | | |
|---|---|---|---|
| | Useful | Typical | Preferred |
| Temperature, °C. | 75 to 275 | 100 to 250 | 125 to 225 |
| Pressure, psig | 0 to 1000 | 0 to 750 | 0 to 500 |
| WHSV, $hr.^{-1}$ | 0.05 to 10 | 0.05 to 7 | 0.1 to 5 |

Process conditions useful in the hydrogenation step of the present invention are shown below.

| Catalytic Hydrogenation Conditions | | | |
|---|---|---|---|
| | Useful | Typical | Preferred |
| Temperature, °C. | 75 to 250 | 75 to 200 | 100 to 175 |
| Hydrogen Partial Pressure, psig | 0 to 1000 | 0 to 500 | 0 to 250 |
| WHSV, $hr.^{-1}$ | 0.05 to 10 | 0.05 to 5 | 0.1 to 0.3 |

EXAMPLES

EXAMPLE 1

Figure 1:
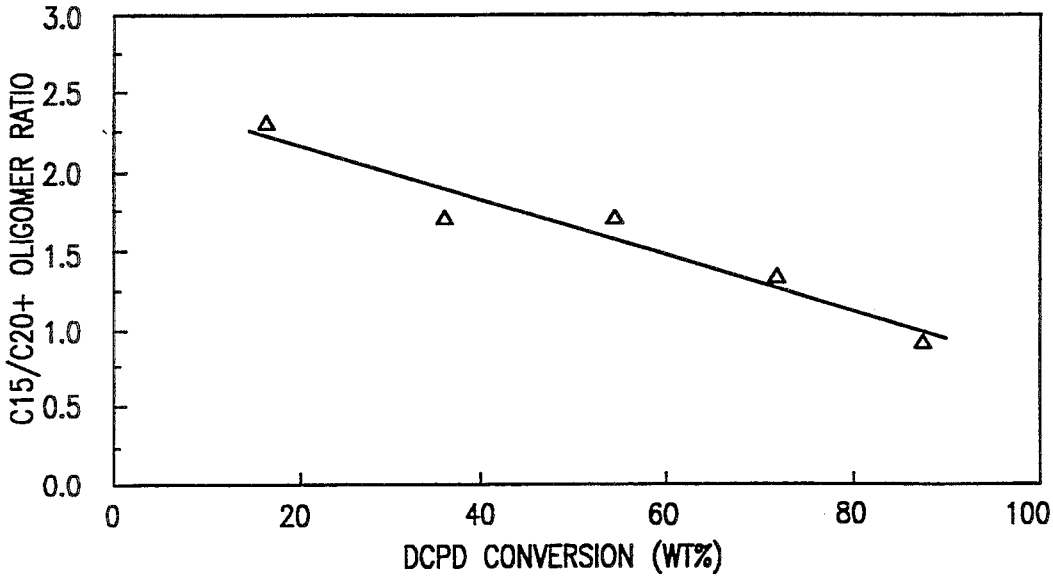
FIG. 1 shows the effect of dicyclopentadiene feed conversion (the x-axis) on the ratio of $C_{15}$ oligomers to $C_{20+}$ oligomers in the reactor effluent stream.
Figure 2A:
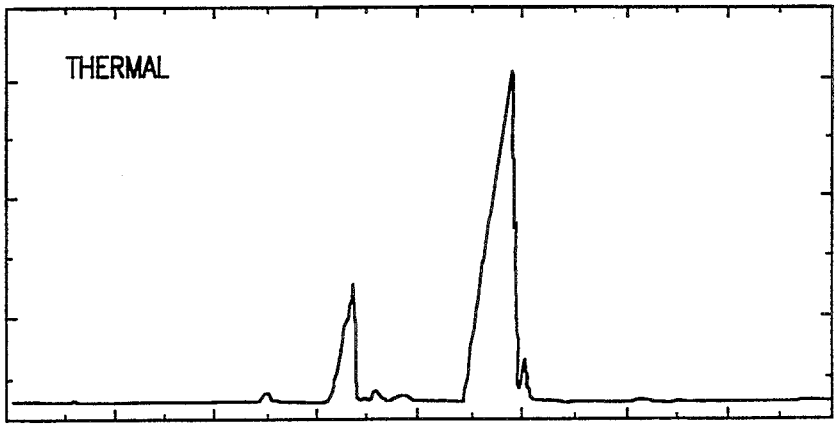
FIG. 2A is a chromatogram of a dicyclopentadiene feed which has been thermally oligomerized to form a product containing cyclopentadiene trimers.
Figure 2B:
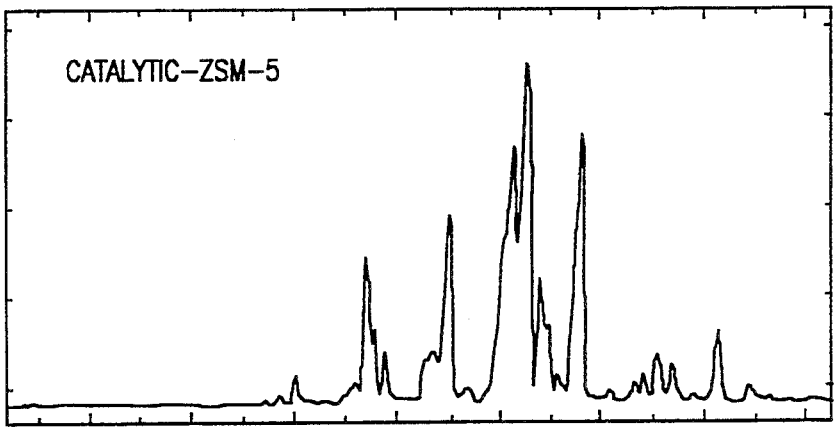
FIG. 2B is a chromatogram of a cicyclopentadiene feed which has been catalytically oligomerized in the presence of a ZSM-5 catalyst to form a more complex product mixture than that produced by the thermal process of FIG. 2A.

3285 grams of cyclopentadiene dimer (95% pure) were charged to an agitated one-gallon glass reactor together with 150.0 grams of ZSM-5 zeolite extrudate catalyst. The reactor was blanketed with nitrogen, heated to 150° C. and the reaction allowed to proceed at 150° C. for 12.2 hours at ambient pressure. The reactor was then cooled to room temperature and analysis by gas chromatography showed 48% of the cyclopentadiene dimer had been converted to cyclopentadiene oligomers having carbon numbers of $C_{15}$ and higher. This reaction product was then transferred to a distillation system and the unreacted cyclopentadiene dimer removed by distillation for subsequent recycle. The total bottoms from the distillation, consisting of the $C_{15}$ and higher cyclopentadiene oligomers, was a low-viscosity liquid at room temperature having a specific gravity of 1.073, a pour point of −32° C. and a net heat of combustion of 156,595 BTU/gallon. After a sample was taken, the remaining $C_{15}$+ oligomeric mixture was hydrogenated using a 5% Pd/Carbon catalyst at 125° C. and 900 psi hydrogen pressure to reduce the olefinic unsaturation. The resulting hydrogenated product was a low-viscosity liquid at room temperature having a specific gravity of 1,044, a freezing point of −34° C. and a net heat of combustion of 155,213 BTU/gallon.

EXAMPLE 2

2053 grams of cyclopentadiene dimer (95% purity) were charged to an agitated one-gallon glass reactor together with 94.2 grams of zeolite beta extrudate catalyst. The reactor was blanketed with nitrogen, heated to 150° C. and the reaction allowed to proceed at 150° C. for 13 hours at ambient pressure. Analysis by gas chromatography showed 45% of the cyclopentadiene dimer had been converted to cyclopentadiene oligomers having carbon numbers of $C_{15}$ and higher. The reaction product was then transferred to a distillation system and the unreacted cyclopentadiene dimer removed by distillation for subsequent recycle. The total bottoms from the distillation, consisting of the $C_{15}$ and higher cyclopentadiene oligomers, was a low-viscosity liquid at room temperature having a specific gravity of 1,073, a pour point of −32° C. and a net heat of combustion of 154,741 BTU/gallon. After a sample was taken, the remaining $C_{15}$ and higher oligomeric mixture was hydrogenated using a 5% Pd/Carbon catalyst at 125° C. and 900 psi hydrogen pressure. The resulting hydrogenated product was a low-viscosity liquid at room temperature having a specific gravity of 1,038, a pour point of −34° C. and a net heat of combustion of 154,211BTU/gallon.

EXAMPLE 3

3100 grams of cyclopentadiene dimer (95% pure) were charged to an agitated one-gallon stainless steel reactor together with 150 grams of a catalyst containing zeolite Beta loaded with 0.6 wt % platinum. The reactor was blanketed with nitrogen, heated to 150° C. and the reaction allowed to proceed at 150° C. for 29.8 hours. Analysis by capillary GC showed 47.5% of the cyclopentadiene dimer was converted to $C_{15}$ and higher polyclopentadienes. The reactor was then cooled to 125° C. and pressurized with hydrogen, and the hydrogenation allowed to proceed for 28.3 hours at 125° C. with 700 psig hydrogen pressure and 4 hours at 125° C. with 900 psig hydrogen pressure. The hydrogenated product was a very low viscosity liquid at room temperature with a specific gravity of 1.013, a heat of combustion of 150,452 BTU/gallon and a minimum cold-flow temperature (pour point) of $<-54°$ C.. Analysis by gas chromatography showed the product to contain 46.8% $C_{15}$ and higher 3,4,8,9-tetrahydropolycyclopentadienes, 38.6% exo-3,4,8,9-tetrahydrodicyclopentadiene (JP−10), 8.6% endo-2,3,8,9-tetrahydrodicyclopentadiene and 6.0% other components comprising impurities in the cyclopentadiene dimer reactant and minor reaction products.

Changes and modifications in the specifically described embodiments can be carried out without departing from the scope of the invention which is intended to be limited only by the scope of the appended claims.

What is claimed is:

1. A two-step process for converting cyclopentadiene dimer to a high density fuel mixture comprising the steps of:

(a) reacting said cyclopentadiene dimer in the presence of a solid catalyst comprising a porous crystalline material having a Constraint Index of from about 0.1 to about 12 under oligomerization/isomerization conditions to convert at least a portion of said cyclopentadiene dimer to an intermediate product containing cyclopentadiene trimer, cyclopentadiene tetramer, and the isomerized and oligomerized products derived from the reaction of at least three cyclopentadiene monomer units;

(b) hydrogenating said intermediate product of step (a) in the presence of a hydrogenation catalyst to form a high energy density fuel.

2. The process of claim 1 further comprising transferring said intermediate product of step (a) to said catalytic hydrogenation step (b) in the absence of a distillation step.

3. The process of claim 2 further comprising charging the total intermediate product of step (a) to said catalytic hydrogenation step (b).

4. The process of claim 1 wherein said porous crystalline material of step (a) has the structure of at least one selected from the group consisting of ZSM−4, ZSM−11, ZSM-12, ZSM−22, ZSM−23, ZSM−35, ZSM−48, MCM−22, PSH−3, SSZ−25, and zeolite Beta.

5. The process of claim 1 wherein said hydrogenation catalyst comprises at least one metal and a porous crystalline material having a Contraint Index of from about 0.1 to about 12.

6. The process of claim 5 wherein said hydrogenation catalyst has the structure of at least one selected from the group consisting of ZSM−4, ZSM−11, ZSM−12, ZSM−22, ZSM−23, ZSM-35, ZSM−48, MCM−22, PSH−3, SSZ−25, and zeolite Beta.

7. The process of claim 1 wherein said oligomerization/isomerization conditions comprise temperature of from about 75° to about 275° C. pressure of from about 0 to about 1000 psig, and WHSV of from about 0.05 to about 10 $hr.^{-1}$.

8. The process of claim 7 wherein said oligomerization/isomerization conditions further comprise temperature of from about 100° to about 250° C., pressure from about 0 to about 750 psig, and WHSV of from about 0.05 to about 7 $hr.^{-1}$.

9. The process of claim 8 wherein said oligomerization/isomerization conditions further comprise temperature of from about 125° to about 225° C. pressure from about 0 to 500 psig, and WHSV of from about 0.1 to about 5 $hr.^{-1}$.

10. The process of claim 1 wherein from about 20 to about 80 weight percent of the cyclopentadiene dimer is converted to a higher cyclopentadiene oligomer in step (a).

11. The process of claim 1 further comprising separating at least a portion of effluent from step (a) and recycling effluent to step (a).

12. The process of claim 11 further comprising controlling the low temperature properties of the high density fuel product of step (b) by adjusting the amount of $C_{10}$effluent from step (a) which is recycled to step (a).

13. The process of claim 1 wherein said hydrogenation catalyst of step (b) comprises at least one metal on an inert support.

14. The process of claim 13 wherein said metal is selected from the group consisting of Groups IVA, VA, VIA, and VIIIA of the Periodic Table.

15. The process of claim 14 wherein said metal is present in the form of an oxide or a sulfide.

16. The process of claim 1 wherein said hydrogenation catalyst of step (b) comprises a zeolite and at least one metal.

17. The process of claim 16 wherein said metal is selected from the group consisting of Groups IVA, VA, VIA, and VIIIA of the Periodic Table.

18. The process of claim 17 wherein said metal is present in the form of an oxide or a sulfide.

19. A two-step process for converting cyclopentadiene dimer to a high density fuel mixture comprising the steps of:

(a) reacting said cyclopentadiene dimer in the presence of a solid catalyst comprising a porous crystalline material having a Constraint Index of from about 0.1 to about 12 under oligomerization/isomerization conditions to convert at least a portion of said cyclopentadiene dimer to an intermediate product containing cyclopentadiene trimer, cyclopentadiene tetramer, and the isomerized and oligomerized products derived from the reaction of at least three cyclopentadiene monomer units;

(b) hydrogenating said intermediate product of step (a) in the presence of said solid catalyst of step (a) to form a high energy density fuel.

20. The product produced by the process of claim 1.

21. The product produced by the process of claim 10.

22. The product produced by the process of claim 11.

* * * * *